United States Patent [19]

Ritter et al.

[11] 4,394,882

[45] Jul. 26, 1983

[54] CONTINUOUS CHAIN BIT WITH DOWNHOLE CYCLING CAPABILITY

[75] Inventors: Don F. Ritter; Jack A. St. Clair; Henry K. Togami, all of Albuquerque, N. Mex.

[73] Assignee: The United States of America as represented by the United States Department of Energy, Washington, D.C.

[21] Appl. No.: 244,573

[22] Filed: Mar. 17, 1981

[51] Int. Cl.[3] ..... E21B 11/06

[52] U.S. Cl. ..... 175/89; 175/379; 175/325; 299/83

[58] Field of Search ..... 175/89, 379, 325; 299/82–84

[56] References Cited

U.S. PATENT DOCUMENTS

| | | | |
|---|---|---|---|
| 2,119,661 | 6/1938 | Whalen | 175/89 |
| 2,134,164 | 10/1938 | Holt | 175/89 |
| 3,978,933 | 9/1976 | Olson et al. | 175/323 X |

OTHER PUBLICATIONS

Oil & Gas Journal–Oct. 8, 1979, pp. 188–189.

S. Varnado et al., "Development and Testing of a Downhole Replaceable Continuous Chain Drill", SPE 8437, Sep. 1979.

*Primary Examiner*—Ernest R. Purser
*Assistant Examiner*—Thuy M. Bui
*Attorney, Agent, or Firm*—James H. Chafin; Albert Sopp; Richard G. Besha

[57] ABSTRACT

A continuous chain bit for hard rock drilling is capable of downhole cycling. A drill head assembly moves axially relative to a support body while the chain on the head assembly is held in position so that the bodily movement of the chain cycles the chain to present new composite links for drilling. A pair of spring fingers on opposite sides of the chain hold the chain against movement. The chain is held in tension by a spring-biased tensioning bar. A head at the working end of the chain supports ther working links. The chain is centered by a reversing pawl and piston actuated by the pressure of the drilling mud. Detent pins lock the head assembly with respect to the support body and are also operated by the drilling mud pressure. A restricted nozzle with a divergent outlet sprays drilling mud into the cavity to remove debris. Indication of the centered position of the chain is provided by noting a low pressure reading indicating proper alignment of drilling mud slots on the links with the corresponding feed branches.

17 Claims, 21 Drawing Figures

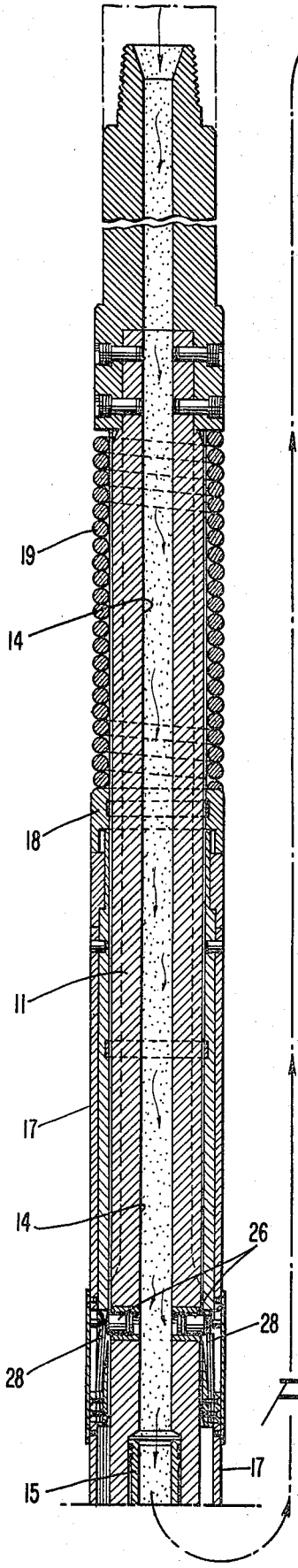
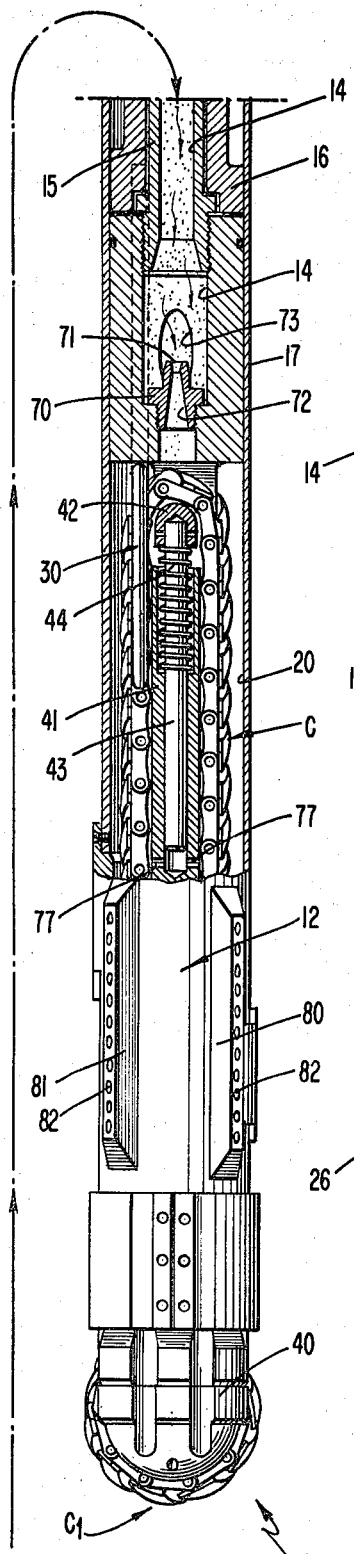
Fig. 2
Fig. 4
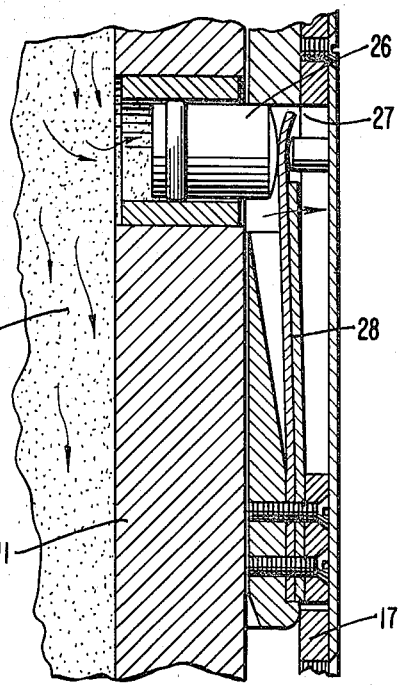
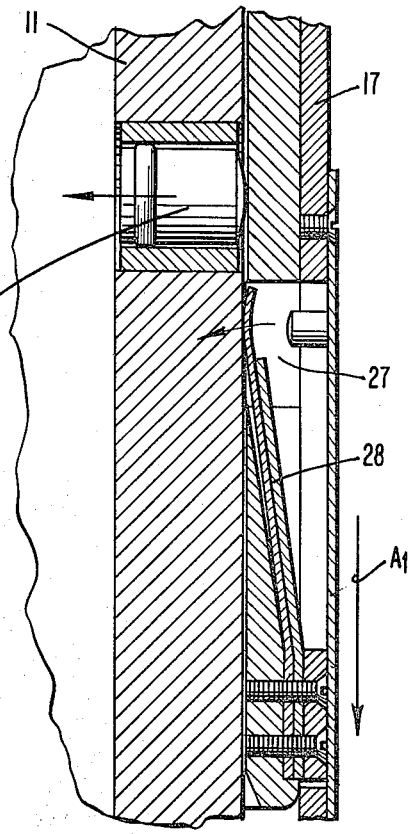
Fig. 5

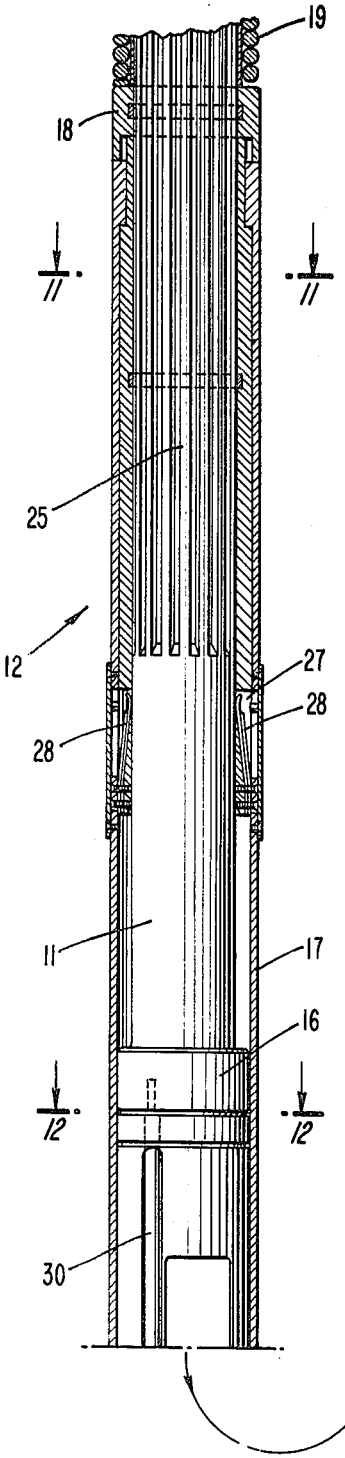
Fig. 16
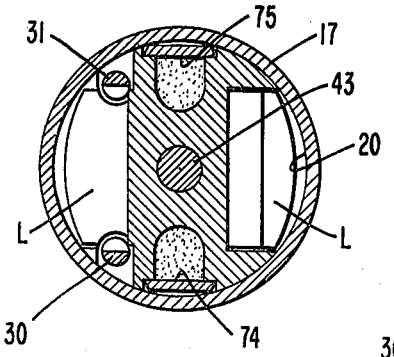
Fig. 15
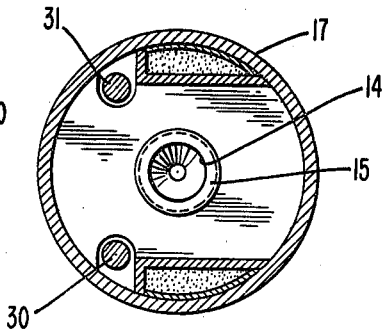
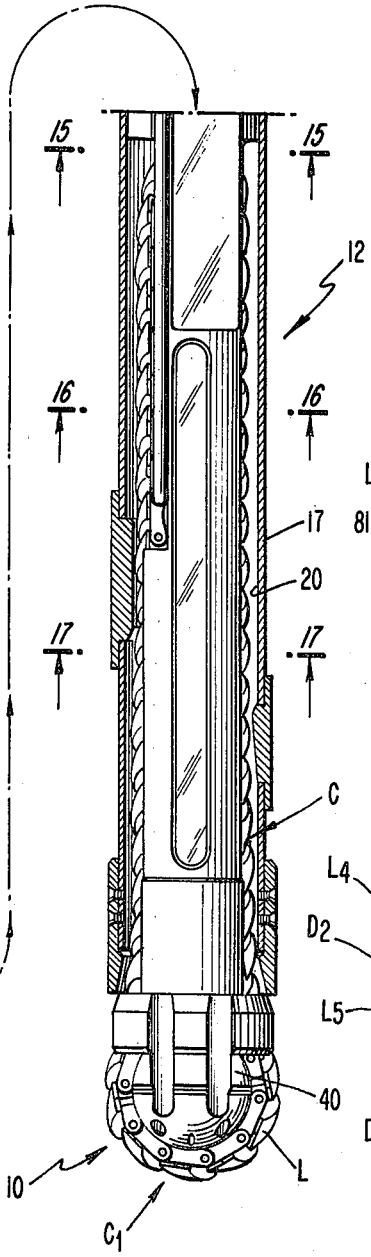
Fig. 6
Fig. 17
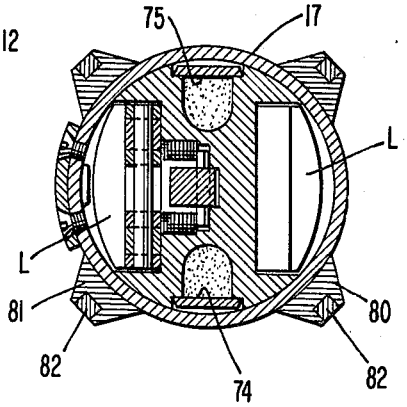
Fig. 18
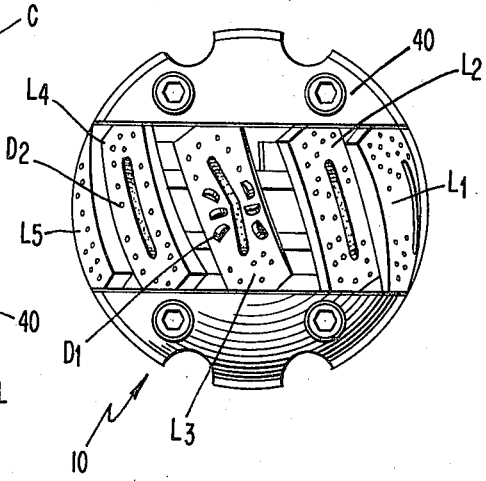

Fig. 12
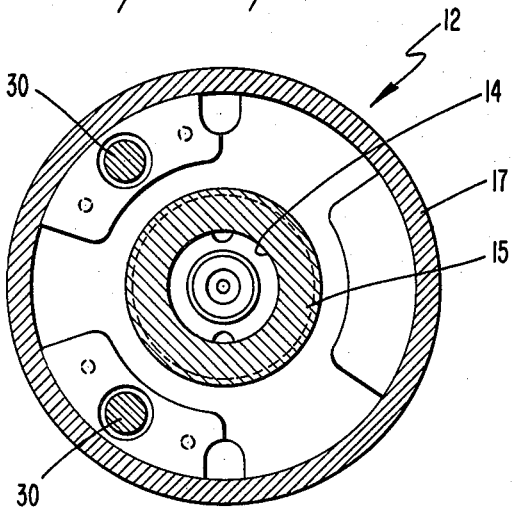
Fig. 11
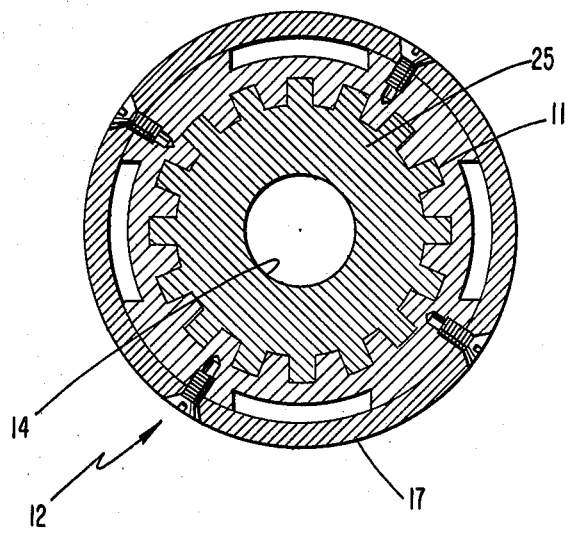
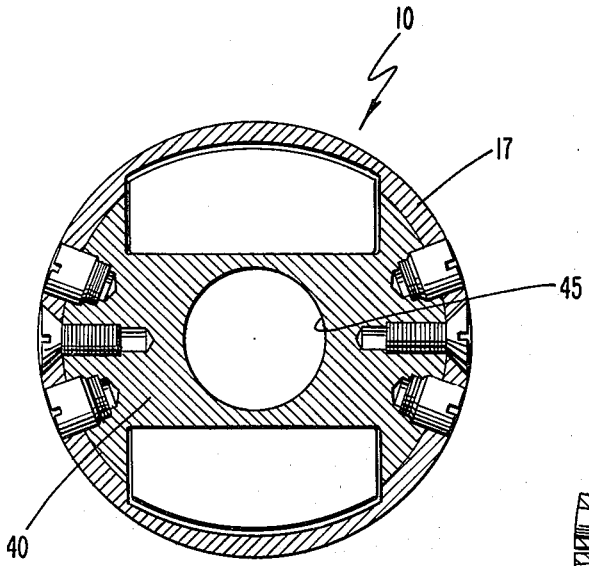
Fig. 13
Fig. 14
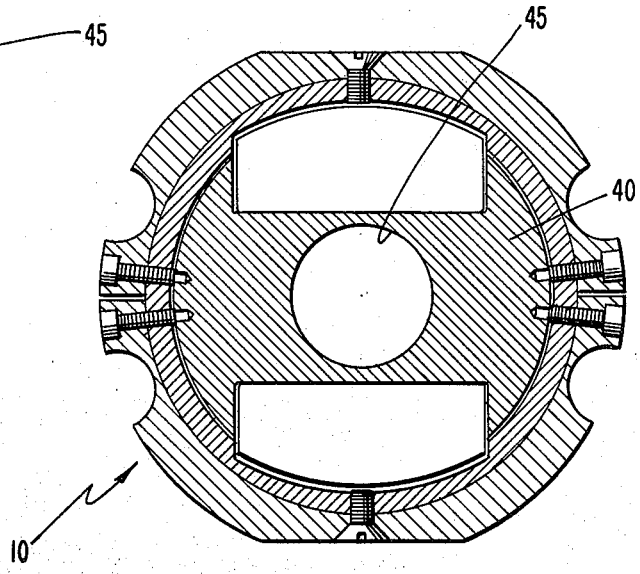

CONTINUOUS CHAIN BIT WITH DOWNHOLE CYCLING CAPABILITY

BACKGROUND OF THE INVENTION

The present invention relates to hard rock drilling, and more particularly, to a continuous chain bit having a self-contained mechanism for downhole cycling utilizing common bit movements and drilling mud pressure.

Continuous chain drill bits are known in the prior art. Basically, a chain is mounted in a housing forming the bit. The outer face of chain links are provided with diamonds and/or synthetic diamond compacts and multiple links are selectively positioned at the bottom of the drill bit to engage the hard rock and drill a borehole. The drilling action of the bit is generated by the rotation of the entire body of the bit thereby moving the diamond-studded links in a rotative pattern against the rock. When the drilling efficiency of the bit decreases to the point where movement is too slow for economic operation, thus indicating that the diamonds are worn, the bit is lifted from the bottom of the borehole and the chain is cycled to bring the next multiple of chain links into the working position. Continuous chain bits are thus, in theory, very efficient, since no longer is the drill bit required to be removed from the borehole when the diamonds are worn. A bit can remain in the borehole through five or more drilling cycles, saving substantial time and expense normally required to raise a bit and replace it.

Heretofore, the continuous chain drill bits that have been tried have been generally unsuccessful. The bits have been found lacking in ease of cycling the chain, the reliability of the working chain links at the bottom of the borehole, and in general, the ruggedness and reliability needed in a drill bit, especially one designed to drill in hard rock, such as granite or the like. Prior designs have suffered from lack of positive means to position and lock the parts in position, especially centering and locking the chain in position during drilling. Purely hydraulic mechanisms, previously used for cycling of the chain, have proven unreliable and inefficient, and generally the bits have required movements during chain cycling that are not compatible with the normal drilling practice. In addition, efficient transfer and distribution of the drilling mud to the working links and the provision for links of greater width to provide a wider drilling path have not heretofore been obtainable.

Thus, in accordance with the present invention, it is an object to provide a new, improved continuous chain drill bit overcoming the above shortcomings of the prior art.

It is a more specific object of the present invention to provide a continuous chain drill bit cyclable while downhole by simple operations, fully compatible with normal drilling practice and utilizing a unique combination of mechanical movements and hydraulic actuation.

It is still another object of the present invention to provide a continuous chain drill bit wherein actual movement between the drilling head assembly and the support body for the bit is utilized to cycle the chain by bodily movement of the chain while holding the chain in position relative to the support body.

It is still another object of the present invention to provide a drill bit having a head assembly that is compact, rugged and reliable in operation.

Still another object of the present invention is to provide a drill bit having a cyclable chain that is moved by simple mechanical movement and centered at the end of the movement by hydraulic means.

SUMMARY OF THE INVENTION

In order to attain the above general and specific objectives of the present invention, a continuous chain drill bit is provided having a support body and a head assembly that are shiftable in the axial direction with respect to each other. The head assembly, when released for axial movement slides downwardly by gravity, assisted by a helical spring. A pair of spring fingers engage the continuous chain mounted in a cavity in the head assembly so as to hold the chain in position with respect to the support body while the chain bodily moves with the head assembly. This movement provides positive advancement of the chain assuring reliable and accurate movement of the chain links to provide new chain links in working position at the bottom of the borehole.

Once the chain has been so advanced, the head is lowered back to the bottom of the borehole. The drilling mud is pumped into the head assembly and responsive detent pins move axially into corresponding openings to securely lock the support body and head into a unit.

Preferably, the movement of the head assembly causes a slight over-travel of the chain during the cycling operation. Then, once the drilling head is picked up again from the bottom of the borehole, which is compatible with normal drilling procedure, a centering piston having a pawl engages the chain to drive the chain in a reverse direction until a second fixed pawl is engaged, thus centering and tensioning the working links for drilling. This centering operation aligns branches for feeding drilling mud to distribution slots in the working links. The alignment immediately reduces the back pressure of the drilling mud, giving the drill operator an indication that the centering has occurred and that drilling can proceed. The drill bit is then lowered to the bottom of the drill hole and the drill bit rotated in the normal manner for drilling the rock.

Other features of the present invention include a restricted nozzle in the flow passage of the drilling mud above the cavity housing the chain. The restriction in the nozzle limits the flow so that the majority of the drilling mud proceeds to the working links as necessary to cool the drilling face and to remove the rock chips. The nozzle, however, has a divergent outlet in order to spray the drilling mud into the cavity and continuously wash debris from around the chain to assure against clogging. The drilling mud divides into two (2) feed channels extending down along the chain in the head assembly, and reconvenes at the bottom of the drill, feeding the drilling mud to the feed branches in a drill head supporting the working links. The chain is supported by the head and by a spring biased tensioning bar at the opposite end. In combination with the tensioning bar, drilling vibrations in the chain are advantageously absorbed.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

A BRIEF DESCRIPTION OF DRAWINGS

FIG. 2 is an additional overall view (2 parts) of the drill bit but with more of the bit shown in cross-sectional view and illustrating the main feed passage through the bit for feeding the drilling mud;

FIG. 4 is an enlarged sectional view showing the locking detent pin with the support body and the head assembly locked, as shown in FIG. 2;

FIG. 5 is another enlarged sectional view showing the locking detent pin, but in the disengaged position and as shown in FIG. 3;

FIG. 6 is a cross-sectional view showing the splined connection between the head assembly and the support body and showing the lower portion of the head assembly in cross-sectional view;

FIG. 8 is an enlarged sectional view simlar to that of FIG. 7, but with the cycling of the chain completed, the bit resting at the bottom of the borehole and the head assembly locked to the support body as in FIG. 2, and with the drilling mud pump on;

FIGS. 11–14 are cross-sectional views taken along the respective cross-section lines of FIG. 1 and FIG. 6;

FIGS. 15–17 are cross-sectional views taken along the corresponding cross-section lines of FIG. 6;

FIG. 18 is a bottom view of the drill bit illustrating the drilling face of the composite five working links;

DETAILED DESCRIPTION OF THE INVENTION

Figures 1, 3:
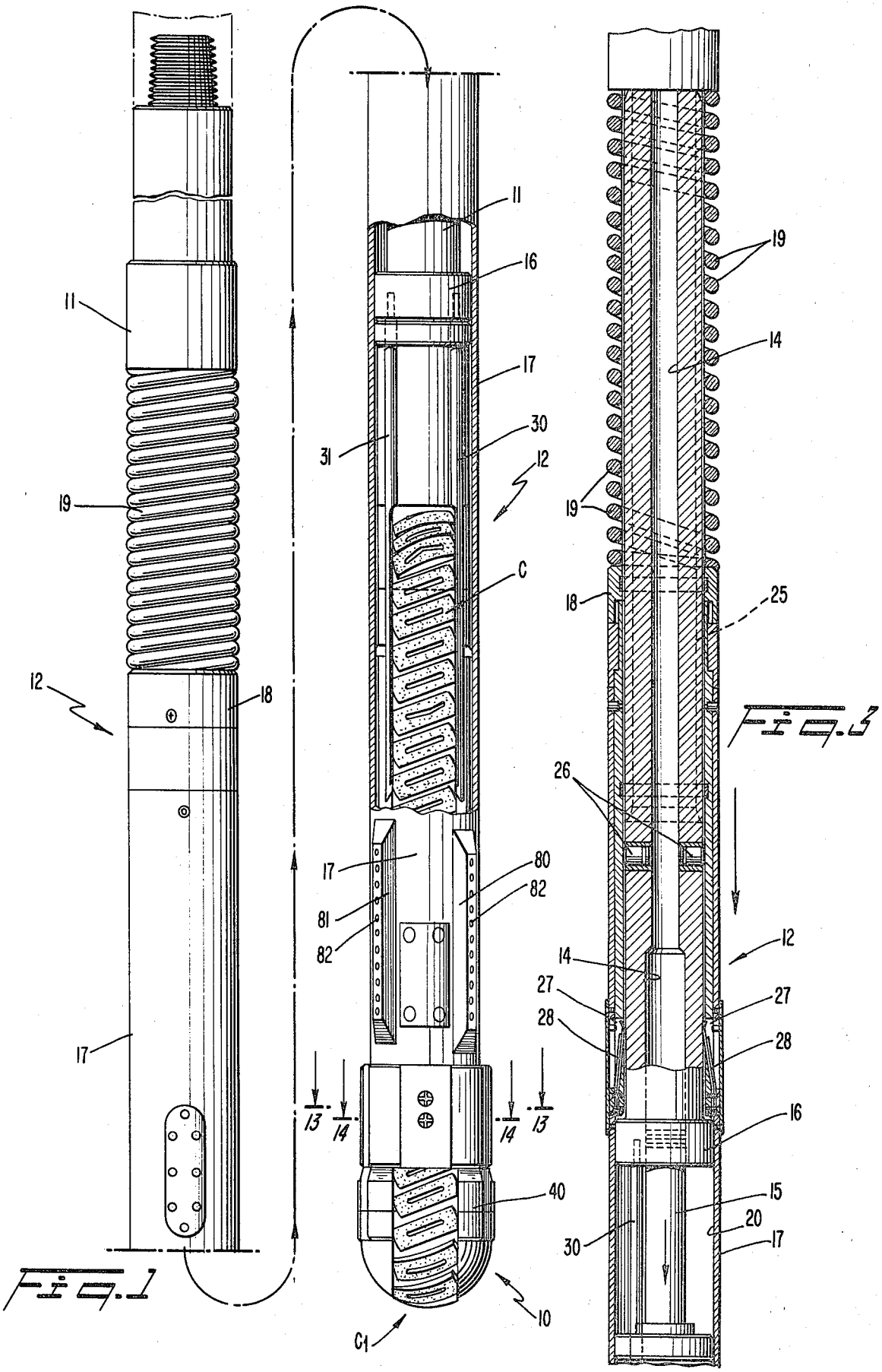
FIG. 1 is an overall view (2 parts) of the continuous chain drill bit with the bit in the locked condition and a portion broken away to illustrate the upper portion of the chain and the holding fingers.
FIG. 3 is a cross-sectional view of the upper portion of the drill bit showing the support body and the head assembly in the axially shifted position to cycle the chain.

With reference now to FIGS. 1 and 2, of the drawings, a continuous chain bit unit 10 is shown including an upper support body 11, and a lower head assembly 12. The support body comprises a shaft having a central feed passage 14 (see FIG. 2) for the drilling mud. A transfer tube 15, carried by the upper end of the internal portion of the head assembly 12 is telescopingly received in the lower end of the support body. Adjacent the transfer tube 15 is a collar 16 defining the lower end of the support body 11. The head assembly 12 includes an outer housing 17 extending well up on the support body 11 and terminating at a ring 18 providing a shoulder for seating of helical spring 19. The head assembly 12 houses a continuous chain, generally designated by the reference indicia C, extending around shaft 41 within a cavity 20 of the outer housing 17 along the lower portion of the head assembly 12. The lower or bottom surface of the chain C defines the drilling face $C_1$ of the bit 10.

SHIFTING OF THE HEAD ASSEMBLY

In accordance with the invention, there is provided a means to shift the head assembly 12 axially with respect to the support body 11. While the shifting is occurring, a finger means holds the chain C in position relative to the support body 11 to cycle the chain C.

First, to describe the axial shifting, it can be seen in FIG. 3, and in conjunction with the upper portion of FIG. 6, that the support body 11 and the upper portion of the head assembly 12 are coupled by a splined coupling 25 (see also FIG. 11). The splined coupling allows the axial movement, as shown in FIG. 3, resulting from the weight of the head assembly 12 and assisted by the helical compression spring 19. The axial shifting movement is permitted by release of axially extending detent pins 26, shown in the lock-up position in FIG. 2 and the released position in FIG. 3. In the lock-up position, the detent pin 26 is urged radially outward by the drilling mud pressure within the feed passage 14 and engages the upper shoulder of the receiving opening 27 of the shaft 41 of the head assembly 12. As long as the detent pin 26 is engaged, the shoulder of the opening 27 prevents the axial movement between the head assembly 12 and the support body 11 retaining the drill bit in the locked condition of FIG. 2. Also, as long as the drill bit remains off the bottom of the borehole, so that the weight of the drilling head 12 remains on the detent pin 26, the drill bit 10 remains locked due to the frictional engagement under the force of the helical spring 19.

However, once the pressurized flow of drilling mud in the passage 14 is terminated, as shown in FIG. 5, and the drilling bit is placed on the bottom of the borehole to release the friction, the pin 26 is driven back into its housing sleeve of the support body 11 by the leaf spring 28 (see FIG. 4). Then, upon lifting the unit from the bottom of the borehole, the head assembly 12 including the outer housing 17 is released and axially slides downwardly, as shown by the arrow $A_1$ of FIG. 5.

CYCLING OF CHAIN BIT

Figure 7:
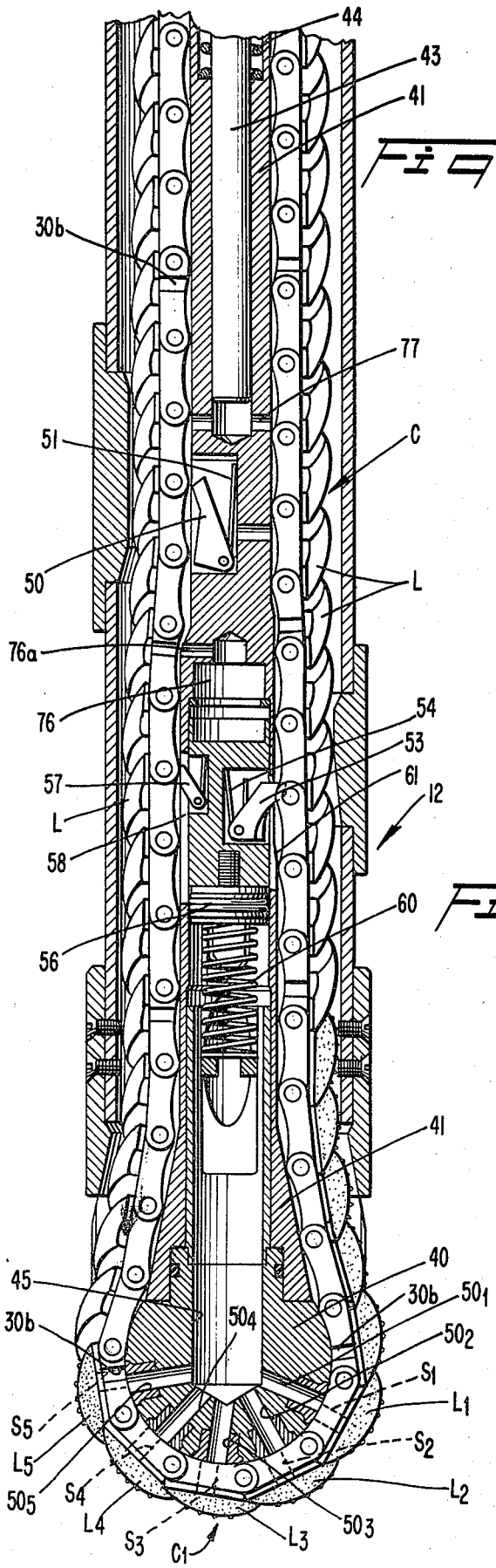
FIG. 7 is an enlarged sectional view, similar to FIG. 6, showing the chain bit with the chain having been cycled (head assembly fully extended) and with drilling mud pump off.
Figure 8:
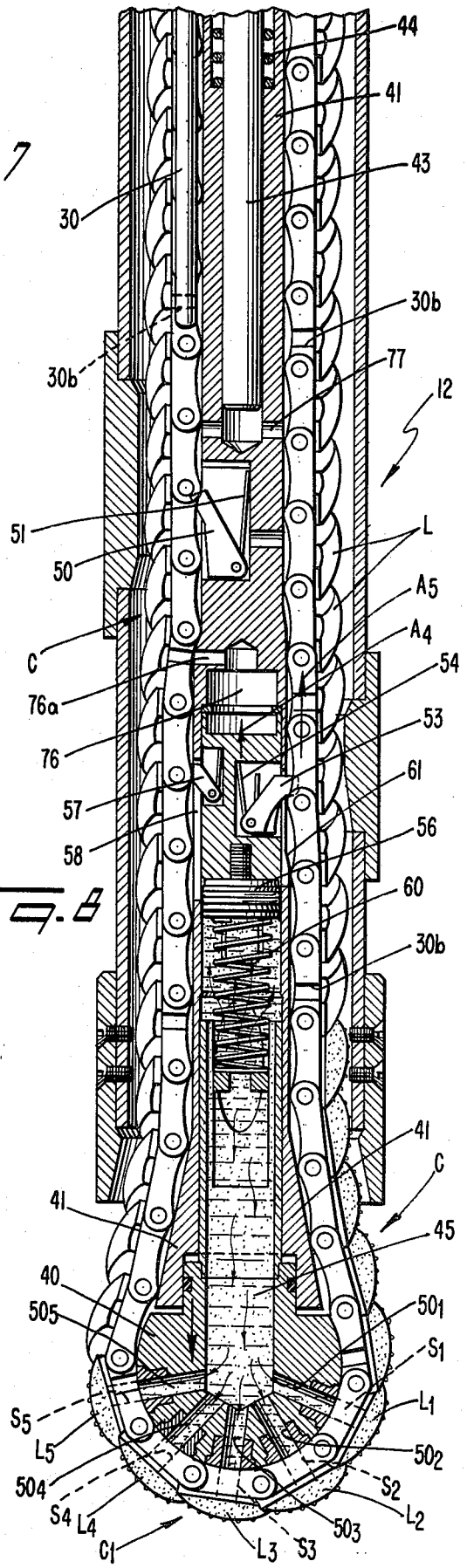
Figure 19:
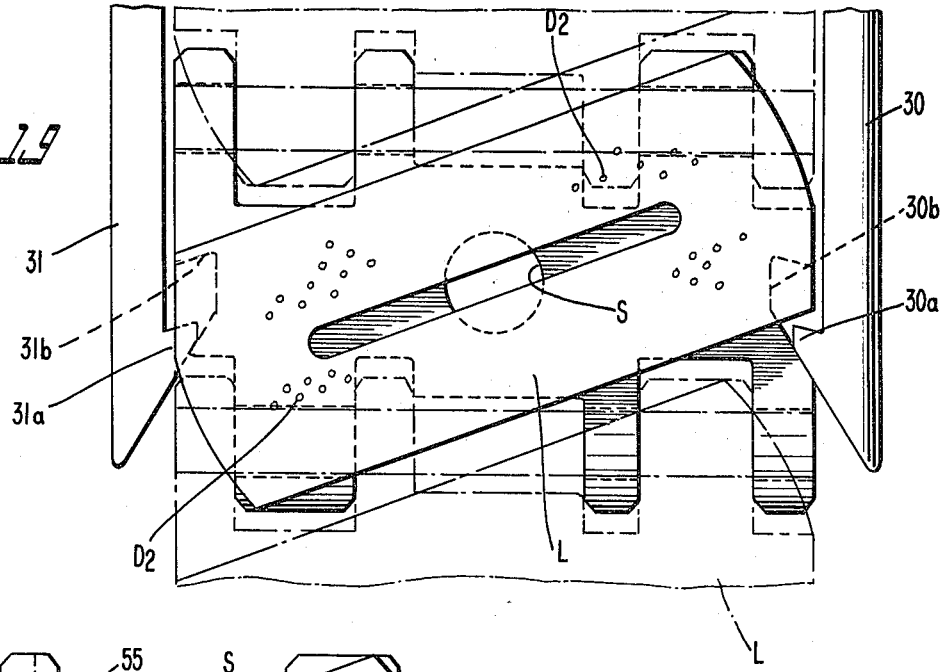
FIG. 19 is an enlarged detailed view of a selected link having cutout notches for receiving the hook ends of the holding fingers.
Figure 20:
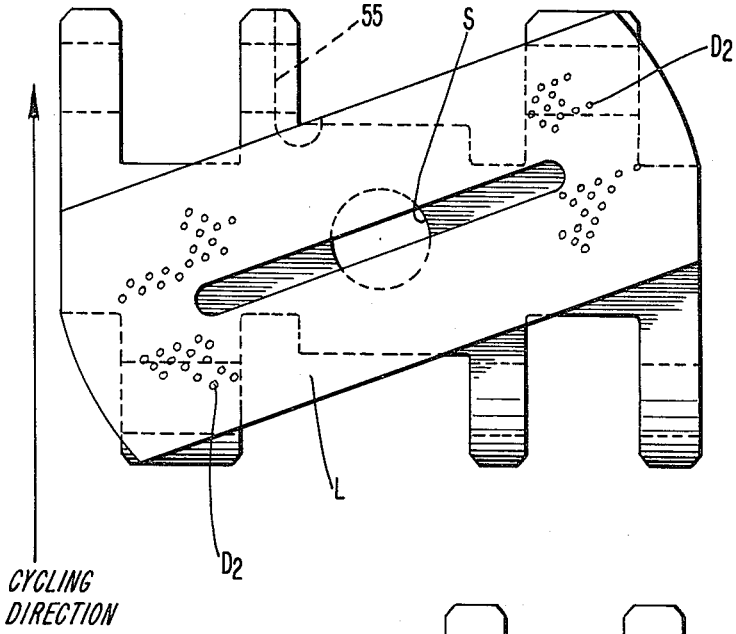
FIG. 20 is an enlarged view of another selected link and showing a notch for receiving the pawl on the reversing piston for centering the chain and the straight drilling mud feeding slot (also as in FIG. 19)
Figure 21:
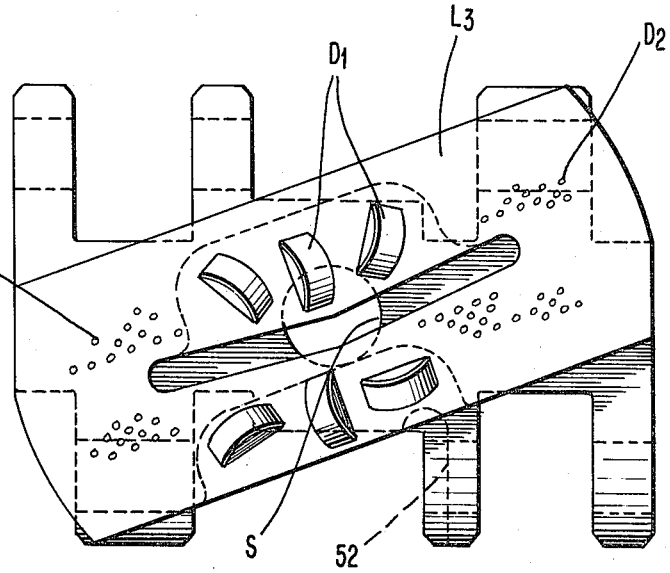
FIG. 21 shows the middle of the five composite working links with the centered, synthetic diamonds, a V-shaped drilling mud distribution slot and a notch for the stationary pawl.

As can be seen from comparing FIGS. 1 and 7, the drilling chain C is made up of a plurality of individual links L. The drilling face $C_1$, at any particular adjusted position includes a plurality of working links $L_1$–$L_5$. The center link $L_3$ (FIGS. 8 and 21) forms the bit pivot point with six (6) polycrystalline diamond cutters $D_1$. The remainder of the surface of the links are provided with selected areas of natural and/or synthetic diamonds $D_2$ (FIGS. 19–21). For each cycling of the chain C, a new group of links $L_1$–$L_5$ are brought into the drilling position. This is accomplished in accordance with the present invention by the movement of the head assembly 12 to bodily move the chain C with finger means holding the chain C relative to the support body 11. The finger means in the preferred embodiment shown take the form of depending spring metal fingers 30, 31 mounted in collar 16 (see FIG. 1) and extending parallel to and on opposite sides of the upper portion of the chain C. As best shown in FIG. 8, the fingers 30 are aligned generally with the body of the chain opposite the ends of the connecting pins of the chain. At the lower ends of the fingers 30, 31 are one way hooks 30*a*, 31*a* engaging in corresponding notches 30*b*, 31*b* of a selected link L (see FIG. 19). The hooks 30*a*, 31*a* are shown not fully engaged with the notches 30*b*, 31*b* to be explained in detail later, but once the notches are engaged and the head assembly 12 is allowed to move in the downward direction, that is axially with respect to the support body 11 (see arrow A2 in FIG. 9), the chain is cycled in the clockwise direction, as shown by the movement arrows A3 of FIG. 9.

The fingers 30, 31 thus engage and hold the chain C with the movement being actually performed by bodily movement of the head assembly 12. This provides a new and unique and highly reliable manner in which to cycle the chain C. The force of the weight of the head assembly 12, plus the spring 19 assures that drilling chips and other debris, or slight binding of the parts, does not hinder the advancement of the chain. Furthermore, the chain is advanced in a precise manner since the fingers 30, 31 are engaging specific, corresponding notches 30*b*, 31*b* of a corresponding link L on each movement. As such, the present invention overcomes a substantial shortcoming of prior designs.

Another important aspect of the present invention is the unique manner in which the chain is supported within the head assembly 12. To back up the working links $L_1$–$L_5$ there is provided a head 40 (see FIGS. 1 and 7, for example). The head is slidably received within an axial bore of shaft 41 of the head assembly 12. The opposite or upper end of the chain C is maintained under constant tension by a guide bar 42 supported by rod 43 mounted in a bore in the shaft 41 and spring biased upwardly by compression spring 44 (see FIG. 2). When the drilling mud pump is on, drilling mud from the feed passage 14 is delivered to the head 40 into lower interconnecting passageway 45 at all times, the spring 44 maintains the chain C in a taut condition, and during operation the hydraulic force of the pressure of the drilling mud against the head assists in this function. Under all circumstances, the chain is held tightly under tension and the substantial forces of drilling are conveniently absorbed and the vibration in the chain is dampened. As a consequence, the chain C has substantially extended life expectancy over prior art chains of continuous chain bits.

CENTERING OF CHAIN FOR DRILLING

Figure 9:
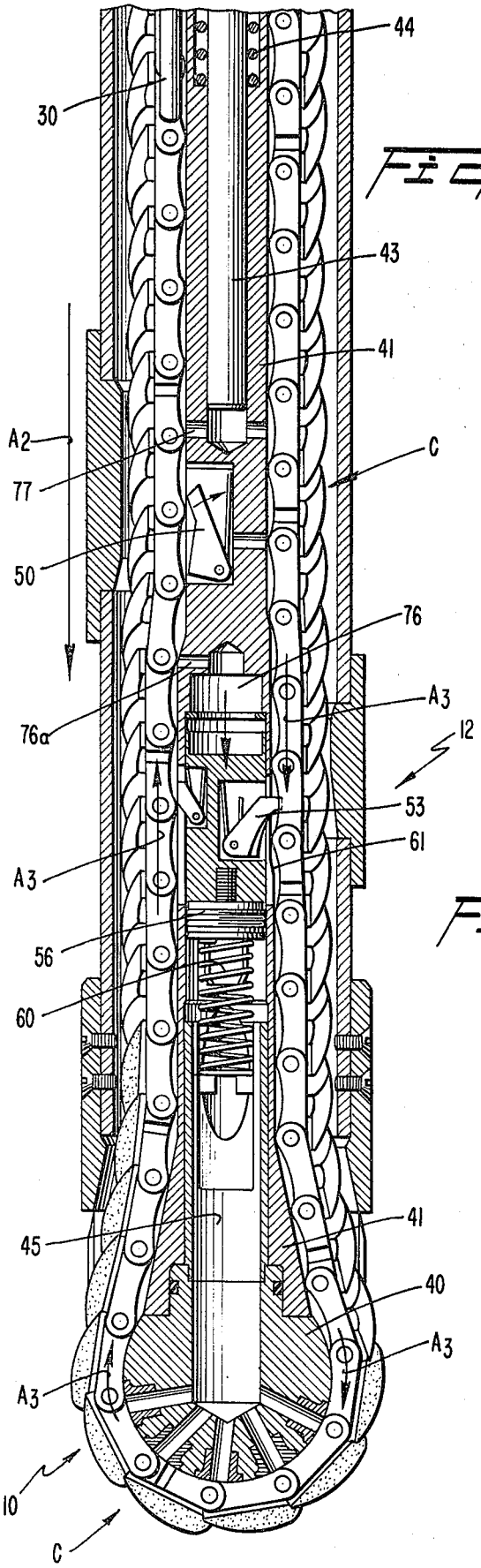
FIG. 9 is an enlarged sectional view showing the chain during the actual cycling operation with the head assembly moving down, the centering piston being forced down by the reversing pawl, and the chain moving in a clockwise direction around the head.

Once the chain has been cycled to bring new working links $L_1$–$L_5$ into position (FIG. 7), the chain C is actually moved past the centered or home position. This is done intentionally and is actually accomplished by simply making the sliding movement of the head 12 approximately ¼ inch longer than required for the fingers 30, 31 to move the chain through the desired distance covering links $L_1$–$L_5$. In other words, the movement of the head assembly 12, as shown in FIG. 9, with the finger 30 at the top of the drawing and just in view, continues as shown by the arrow A2, to the position of FIG. 7, with the finger 30 out of view and the head assembly 12 at the maximum lowered or extended position. In this position, the links $L_1$–$L_5$ can be seen to be beyond the home or centered position since feed branches $50_1$–$50_5$ are shown not to be in alignment with the corresponding inlet ports of slots $S_1$–$S_5$ of the links $L_1$–$L_5$. Under these circumstances, when the mud pump is turned on, as is conventional practice while the drill bit is still off the bottom of the borehole, the pump pressure is high due to the restriction of flow of the drilling mud between the branches $50_1$–$50_5$ and the inlet ports of slots $S_1$–$S_5$. When this high pressure is noticed, the drill operator is able to confirm that the chain has actually cycled by moving the old, worn drilling links and bringing new, fresh drilling links $L_1$–$L_5$ into position on the head 40.

Next, and again in accordance with normal drilling procedures, the drilling bit is lowered into the bottom of the borehole, the support body 11 telescopes into position within the head assembly 12 compressing the spring 19. The fingers 30, 31 ratchet over the sides of the chain C to the new position, substantially comparable to the position of finger 30 in FIG. 8 (c.f. absence of finger 30 in FIG. 7 with head assembly 12 extended). The new position for the one way hooks 30*a*, 31*a* is shown in FIG. 19, as described above. In other words, the hooks 30*a*, 31*a* are at this point not seated within the notches, but are approximately ¼ inch–½ inch down, meaning that the chain C has been cycled ¼ inch–½ inch too far, or beyond the centered position.

Within the center shaft 41 of the head assembly 12, is a first pawl 50 that extends away from the head 40 and in the direction of the hooks 30*a*, 31*a*. The pawl 50 is urged toward the chain C by a biasing spring 51, and the pawl is designed to seat within a notch 52 (see FIG. 21). A second pawl 53 urged toward the opposite run of the chain by a spring 54, is designed to seat within a notch 55 of another link (see FIG. 20).

The pawl 53 is carried on a reversing cylinder 56 in the shaft 41, which piston 56 moves axially in response to the hydraulic pressure of the drilling mud on the lower side of the piston as shown in FIG. 8. The piston also carries a pivotal pin 57 operating within a guide slot 58 to prevent rotation of the piston 56. The pawl 53 extends through a similar slot (not numbered) on the opposite side of the piston 56. Thus, when the drill bit 10 is once again lifted from the bottom of the borehole, again in accordance with normal drilling procedures and with the drilling mud flowing, the piston 56 is urged upwardly away from the drilling head 40, as shown by the arrow A4, the pawl 53 engages the corresponding notch 55 reversing the chain C in the direction of the arrow A5 (FIG. 8).

The chain C is tightened, the branches $50_1$–$50_5$ are aligned with the corresponding parts of the slots $S_1$–$S_5$ once again allowing free flow of the drilling mud through the slots and onto the drilling face $C_1$. The drilling operator advantageously has a positive reading that the new links are in position. The reading is obtained by noting the lower mud pressure due to elimination of the backpressure mentioned above. As the chain C is tightened in the reverse direction, the pawl 50 seats within its notch 52 in the corresponding link L and the hooks 30*a*, 31*a* may be drawn further into the corresponding notches 30*b*, 31*b* in readiness for the next cycling operation.

As the chain C is cycled on the next cycling operation (see arrow A3 of FIG. 9), the first pawl 50 pivots back and ratchets past each of the chain links (see arrow in FIG. 9). The pawl 53 on the other hand, is held in its notch 55 so as the chain C first starts to move in the direction of the arrows A3, the piston 56 is moved downwardly toward the head 40 against compression spring 60. A cam 61 along the side of the shaft 41 urges the chain links slightly outwardly just enough to move the notch 55 off the end of the pawl 53, thus releasing the chain C. The pawl 53 then proceeds to slide over the chain until the next notch 55 is engaged. At this point, since the chain C is still being driven by the fingers 30, 31 to provide the desired over-travel, and since there is no pressure below the piston 56, the spring 60 may be compressed and remain so until the pressure once is again applied and the reversing operation of the chain takes place to bring the working links back to the home position of FIG. 8. With this arrangement, accurate positioning and supplemental tensioning of the chain on the head 40 is fully assured.

WASHING OF CHAIN CAVITY

With reference to FIG. 2 of the drawings, there can be seen a restricted nozzle 70, positioned in the feed passage 14 of the head assembly 12. The inlet port 71 is small in order to meter a limited amount of incoming drilling mud into the chain cavity 20. In accordance with the invention, a diverging outlet orifice 72 allows the fluid to spray outwardly in a cone pattern to drench the entire top of the chain C and to effectively clean the entire inside of the cavity 20 by high pressure fluid flow.

Figure 10:
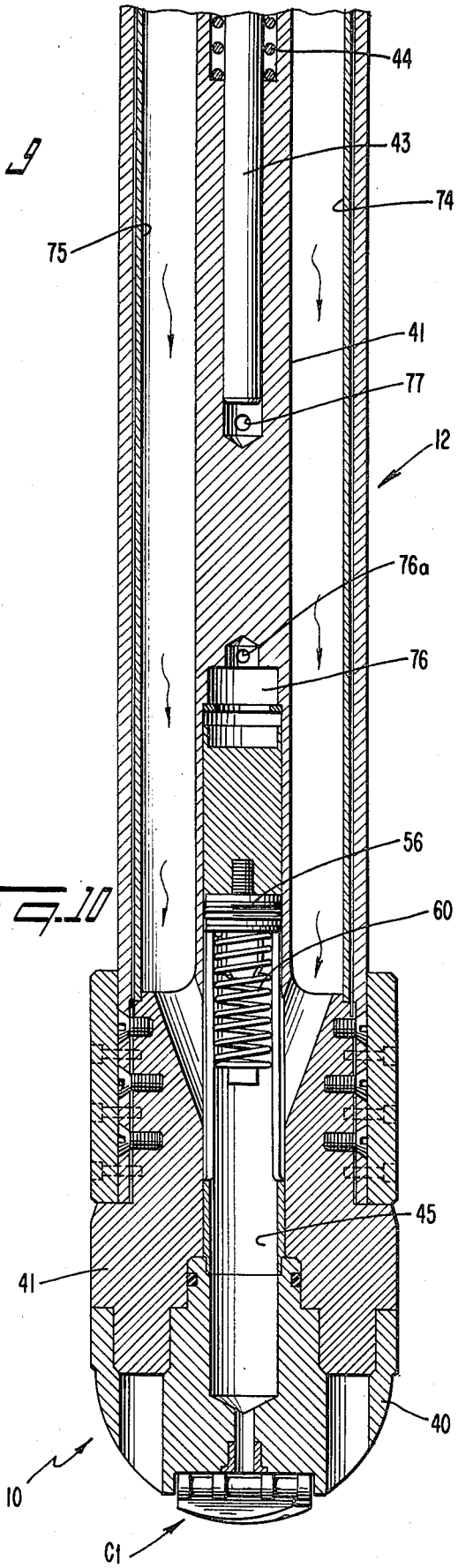
FIG. 10 is a cross-sectional view at 90 degrees with respect to FIG. 9 and showing the drilling mud flow channels along the sides of the head assembly.

The restriction of the inlet port 71 assures that most of the drilling mud is diverted into side openings 73, only one of which is shown in FIG. 2. These openings lead to parallel feed channels 74, 75 (see FIG. 10) extending down along the side of head assembly 12 and along the sides of the chain C (c.f. FIG. 9). Just below the position of the reversing piston 56, the channels 74, 75 reconverge into the interconnecting passageway 45 feeding the drilling mud to the links $L_1$–$L_5$ and providing the hydraulic pressure for actuation of the piston 56. A suitable relief chamber 76, with a fluid exit orifice **76*a* (see FIG. 9 also) is provided above the piston 56 to prevent trapping of fluid that would otherwise prevent proper operation of the piston 56. Similarly, the lower end of the bore for the support rod 43 is vented by port 77** to prevent pressure build up.

STABILIZING OF BIT

Along the lower portion of the head assembly 12 are provided a plurality of stabilizer blades 80, 81 (see FIG. 1). These blades are adapted to engage the sides of the borehole and to provide stability to the head assembly during the drilling operation. Carbide inserts 82 may be provided along the blade to provide wear resistance. As can be understood from viewing FIG. 2, the outer extent of the carbide inserts is such as to be substantially guided by the borehole made by the cutting face $C_1$ of the drilling chain C.

In summary, the present invention provides a continuous chain bit for hard rock drilling that is compact in design and extremely efficient to operate. The chain C is efficiently cycled and locked in position for drilling by a combination of mechanical and hydraulic mechanisms. Depending spring fingers 30, 31 hold the chain while the head assembly 12 is released for axially sliding movement. The chain over-travels a slight distance assuring that in each operation the chain can be brought to the home position. A reversing piston 56 and pawl 53 operate to reverse the chain bringing the chain to the home position and assuring the tensioning of the links $L_1$–$L_5$ for drilling. When the chain C is thus centered, the flow of drilling mud without back pressure provides an indication to the drill operator that the links are properly centered.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A continuous chain bit for hard rock rotary drilling and down hole cycling comprising:

a support body;

an auxiliary slidable drill head assembly on said body;

means for effecting rotation of the drill head assembly upon rotation of the support body;

means to shift said head assembly longitudinally relative to said body;

an endless chain on said head assembly having links for cutting into the rock and moveable along a feed path; and finger means carried by the support body to engage and hold said chain with respect to the support body while shifting said head assembly longitudinally relative to said support body, whereby said chain may be moved along the feed path and cycled to present new links for drilling.

2. The continuous chain bit as claimed in claim 1, wherein said chain is mounted in an elongated vertical cavity and said head assembly includes a head having a curved support surface at the lower end of the cavity for positioning a portion of the working chain links for drilling at the bottom of the borehole, a guide bar at the upper end of said cavity and spring means for urging said bar upwardly against said chain to keep the same taut and stabilize the working chain links and to dampen chain vibration during drilling.

3. The continuous chain bit as claimed in claim 2, wherein is further provided pawl means intermediate the ends of said cavity for engaging said links and centering means for urging at least one of said pawls to assure centering of said portion the working links in said chain at the bottom of the borehole.

4. The continuous chain bit as claimed in claim 3, wherein said pawl means includes first and second pawls on said head assembly facing in opposite directions, biasing means to urge said pawls toward the chain, and corresponding notches on said chain for receiving the pawls.

5. The continuous chain bit as claimed in claim 3, wherein said head assembly shifts sufficiently to provide slight overtravel of the working links past the centered position, said centered means including a reversing piston carried in said head assembly and fluid pressure means serving to urge the reversing piston away from the head to move the chain in reverse to the centered position.

6. The continuous chain bit as claimed in claim 5, wherein said fluid pressure means comprises a feed passage for feeding drilling fluid to the working chain links at the bottom of the bore hole, each of said chain links including a fluid feeding slot, said head assembly including a plurality of branch passages alignable with said fluid feeding slots to provide high pressure drilling fluid through the links to the bottom of the bore hole, wherein the over travel of the head assembly during cycling is sufficient to misalign the branch passages and the corresponding slots in the working links for creating a resistance in the fluid flow to said slots thereby providing an increase in pressure in the fluid, said branches being aligned with the slots upon completion of the reverse movement removing said restriction and providing a lower drilling fluid pressure.

7. The continuous chain bit as claimed in claim 5, wherein said head is slidably mounted for guiding and tightening action on the chain in response to said fluid pressure means.

8. The continuous chain bit as claimed in claim 7, wherein said first pawl is mounted in a fixed axial position on said head assembly, said reversing piston in said head assembly carrying said second pawl.

9. The continuous chain bit as claimed in claim 8, wherein said reversing piston includes a pin engaging a guide slot on said head assembly holding said piston against rotation.

10. The continuous chain bit as claimed in claim 8, wherein is provided a spring between said reversing piston and said head to allow withdrawing movement of said piston toward said head and allow disengagement of said second pawl from said chain upon interruption of the pressure from said pressure means and cycling movement of said chain.

11. The continuous chain bit as claimed in claim 10, wherein is provided a cam under said chain adjacent said second pawl to provide lifting action on said chain to assist in the disengagement of said second pawl.

12. The continuous chain bit as claimed in claim 1, wherein is provided at least one free-floating radial detent pin mounted in said support body, a receiving opening in said head assembly to provide axial lock-up of said head assembly and a feed passage for high pressure drilling mud for actuating said detent pin.

13. The continuous chain bit as claimed in claim 12, wherein is provided a leaf spring in said opening for urging said detent pin back into said support body to release the head assembly for axial shifting.

14. The continuous chain bit as claimed in claim 1, wherein said finger means includes at least one elongated finger depending from said support body, said finger means extending adjacent and parallel to said chain on said head assembly, a one-way hook on the end of said finger, and a corresponding notch on said chain for receiving the hook.

15. The continuous chain bit as claimed in claim 14, wherein is provided an additional finger, including a one-way hook end positioned on the opposite side of said chain, said fingers being spring metal to urge the hooks toward each other and into the corresponding notches, the hooks serving to cycle the chain as the head assembly axially moves in one direction and return when moving in the opposite direction.

16. The continuous chain bit as claimed in claim 2, wherein said chain is mounted within a cavity in said head assembly, a feed passage for feeding high pressure drilling mud to the head assembly, a restricted nozzle in said passage having a divergent outlet positioned adjacent the upper end of said cavity adjacent said guide bar to allow spray washing along the entire length of the chain in the cavity.

17. The continuous chain bit as claimed in claim 16, wherein said feed passage divides adjacent said nozzle into two side channels extending down along said chain cavity and converging again adjacent said head to feed the drilling mud to the working chain links at the bottom of the borehole.

* * * * *